US005108166A

United States Patent [19]

Klix

[11] Patent Number: 5,108,166

[45] Date of Patent: Apr. 28, 1992

[54] VENDING MACHINE SECURITY SYSTEM

[76] Inventor: Klaus Klix, 5563 Hillard Rd., Everson, Wash. 98247

[21] Appl. No.: 610,856

[22] Filed: Nov. 7, 1990

[51] Int. Cl.[5] ..... A47B 88/00

[52] U.S. Cl. ..... 312/329

[58] Field of Search ..... 312/216, 245, 329; 109/49.5, 597, 24.1, 24; 70/18

[56] References Cited

U.S. PATENT DOCUMENTS 773,288 10/1904 Horcheler et al. .
1,965,941 7/1934 Jacob .
2,407,049 9/1946 Winarsky et al. .
3,174,314 3/1965 Johnson .
3,665,736 5/1972 Wilson .
3,833,104 9/1974 Blum .
3,902,603 9/1975 Wilson ..... 211/4
3,910,393 10/1975 de Crepy .
4,134,279 1/1979 Ross et al. ..... 70/18
4,418,551 12/1983 Kochackis .

*Primary Examiner*—Joseph Falk
*Attorney, Agent, or Firm*—Hughes & Multer

[57] ABSTRACT

The specification describes a security system for protecting vending machines from vandalism and theft of the goods or money contained therein. The security system includes a cage and a door rotatably attached to one side of the cage. The cage is securely fixed to the floor on and/or wall against which the vending machine is placed. The door is lockable by a unique locking system and has a seam protection structure formed in the frame of the door for protecting vulnerable seams existent on the front of the vending machine. The security system is adjustable and formed from rugged steel bars.

37 Claims, 7 Drawing Sheets

VENDING MACHINE SECURITY SYSTEM

TECHNICAL FIELD OF THE INVENTION

The present invention relates to security systems, and more specifically to novel, improved vending machine security systems for protecting vending machines from vandalism and theft.

BACKGROUND OF THE INVENTION

Vending machines are often left unattended for days at a time in publicly accessible places. Such machines are vulnerable to (a) theft of the money and goods contained therein and (b) vandalism. More specifically, seams (a) on the front of a vending machine between the main front panel and the selection panel; or (b) around a door covering the front of the vending machine may be jimmied in an attempt to obtain the goods or money stored within the machine. Even if the attempt at theft is unsuccessful, extensive and irreparable damage of the vending machine may result. Further, when such vending machines are free standing, they may be tipped over, again resulting in extensive damage.

To solve these problems of vandalism and theft, a number of vending machine security systems and other superficially related security systems have heretofore been proposed. Those of which applicant is aware are disclosed in U.S. Pat. Nos. 3,833,104, issued Sep. 3, 1974 to Blume for "VANDAL-PROOF CENTRAL COIN RECEPTACLE"; 3,910,393, issued Oct. 7, 1975 to de Crepy for "COIN TELEPHONE ANTI-JIMMY CABINET"; 773,288, issued Oct. 25, 1904 to Horcheler et al for "CASING FOR VENDING MACHINES"; 1,965,941, issued Jul. 10, 1934 to Jacobi for "LOCK"; 3,174,314 issued Mar. 23, 1965 to Johnson for "GATE LOCKING APPARATUS"; 4,418,551, issued Dec. 6, 1983 to Kochackis for "VENDING MACHINE SECURITY CAGE"; 3,665,736, issued May 30, 1972 to Wilson for "UNIVERSAL TELESCOPING LOCKING BAR FOR VENDING MACHINES"; and 2,407,049, issued Aug. 9, 1945 to Winarsky et al for "TIRE INFLATION GUARD".

Each of the foregoing references contain drawbacks rendering the security devices disclosed therein incapable of providing adequate protection of vending machines. As examples:

(a) none of the references cited are designed to prevent the intentional tipping over of a free standing, floor mounted vending machine;

(b) none of the cited references provide external protection of the important vulnerable seams existent on common vending machines; and (c) the locking devices disclosed therein do not securely and economically prevent unauthorized access to front panels of vending machines to be protected.

SUMMARY OF THE INVENTION

Disclosed herein is a new and novel security system for vending machines that does not contain the above-discussed, or other, disadvantages of heretofore proposed vending machine security systems.

Generally speaking, the novel security system disclosed herein includes a cage formed from front and back vertical support members, top and bottom side support members, and top and bottom back support members. The placement and length of the back support members may be adjusted to accommodate vending machines of different depths and widths. A door is rotatably attached to top and bottom side support members on one side of the security cage. The door is locked at two points to the top and bottom side support members on the other side of the security cage by a securing mechanism. When the door is locked to the side support members, the corner seams on the vending machine are substantially protected by the security cage.

Additionally, a seam protection structure is formed on the door to protect seams around the vending machine cash box and selection panel. The seam protection structure may include metal bars arranged in different configurations corresponding to different vending machines to be protected.

A novel securing mechanism may also be provided which secures the door at two points to top and bottom side support members. The securing mechanism comprises a steel locking bar rotatably attached at one point to a top side support member and at another point to a bottom side support member. Locking portions having flat surfaces are formed on the bar. Claw-shaped securing members extending from the door encircle the locking portions on the bar when the door is closed. The bar is then rotated 90° such that one flat surface of the locking portion is presented to an open section of the claw shaped member. The length of the flat surface is greater than the opening in the claw shaped member. Accordingly, the door cannot rotate away from the open position because an inner surface of the claw shaped members abuts the locking portion.

The security system herein disclosed has been found to be particularly effective at preventing vandalism of vending machines for at least the following reasons.

1. The present security system presents a formidable physical barrier to forced entry through vulnerable seams on the vending machine. The seam protection structure, especially when coupled with the cage and securing and locking mechanisms, prevents insertion of a tool into these seams.
2. The present invention also erects a psychological barrier which deters vandals from attempting to gain entry into the vending machines. In tests, vending machines protected by the security cage herein described have been left undamaged while nearby unprotected machines have been damaged by vandals.
3. The present invention erects barriers to vandalism while still allowing the vending machine to advertise and dispense the product contained therein without visual or physical impediments.

OBJECTS OF THE INVENTION

From the foregoing, it is apparent that the provision of a novel, improved vending machine security system is one primary and important object of the invention.

Other, also important, but more specific objects of the invention include the provision of a security system that:

(a) allows easy adaptation to vending machines of various widths, depths, heights, and front panel arrangements;

(b) protects the vulnerable points of seams existent on a closed vending machine;

(c) does not substantially inhibit selection and extraction of products by a user of the vending machine or servicing of the vending machine by service personnel;

(d) prevents the intentional tipping over of the protected vending machines;

(e) provides a locking device that securely locks a door of the vending machine to support members of the vending machine;

(f) allows purchasers of the vending machine to provide their own locks for locking the security cage herein disclosed; and (g) may easily be affixed to a floor on and/or wall against which the vending machine is to be placed.

DETAILED DESCRIPTION OF THE DRAWINGS

Figure 1:
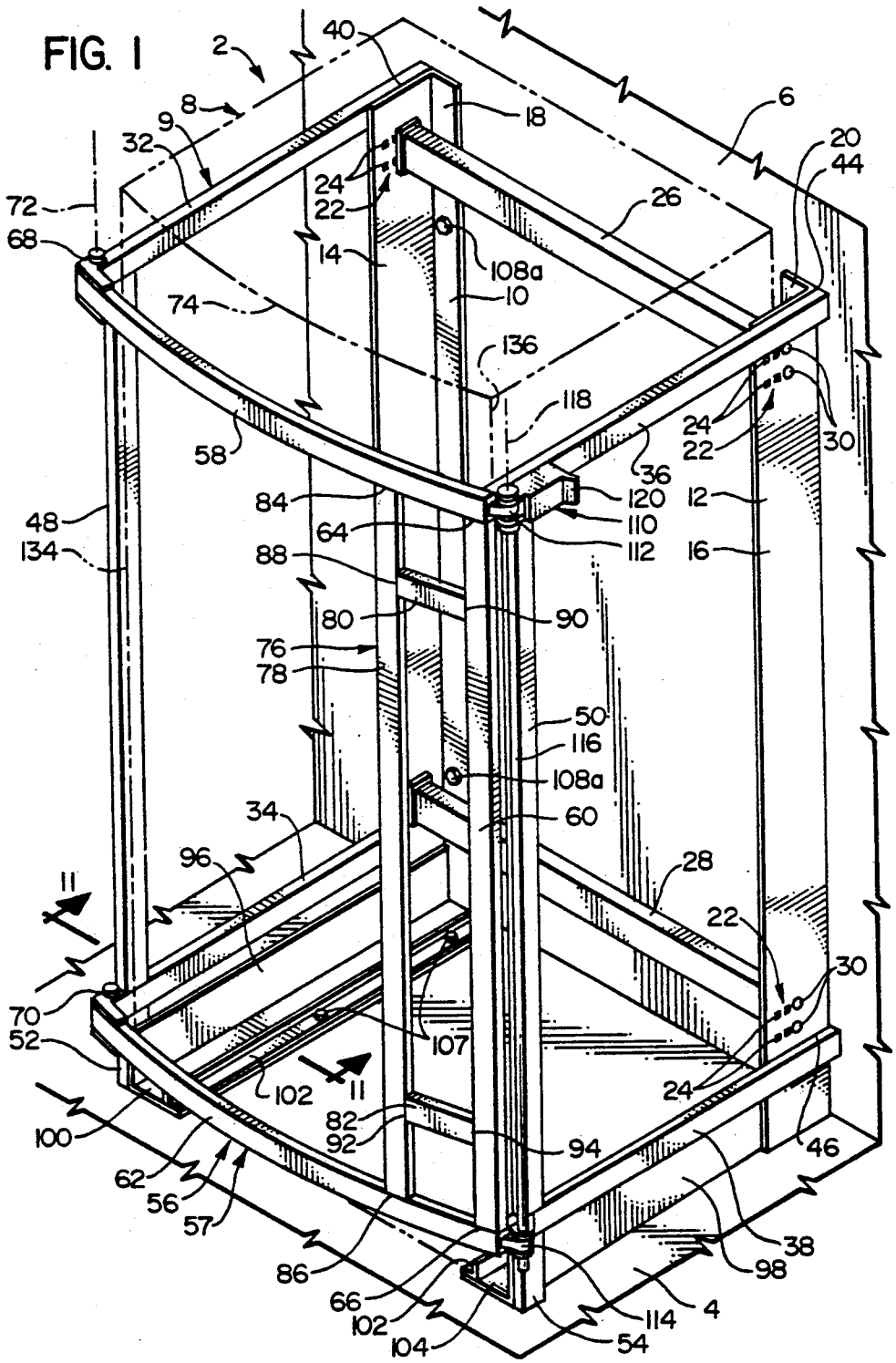
FIG. 1 is a perspective view of a security system constructed in accordance with the principle of the present invention.

Referring now to the drawings, FIG. 1 depicts a security system 2 constructed in accordance with, and embodying, the principles of the present invention. Security system 2 stands on a floor 4 and against a wall 6. Dashed lines indicate a vending machine 8 enclosed within and protected by security system 2.

A free-standing metal cage 9 of the present invention will first be described. Left and right vertical back support members are indicated by reference characters 10 and 12, respectively. Back support members 10 and 12, which are formed from angled steel having an L-shaped cross-section, are arranged in a substantially parallel, mirror-image relationship. Elongate portions 14 and 16 thereof oppose each other, and short portions 18 and 20 thereof are substantially co-planar.

Sets 22 of holes 24 are formed at the tops and bottoms of elongate portions 14 and 16 of back support members 10 and 12. In each set 22, six holes 24 are arranged in two rows and three columns. Penetrating holes 24 are bolts 30 for fixing upper and lower back support members 26 and 28 between vertical back support members 10 and 12.

Horizontal back support members 26 and 28 may be fixed to holes 24 in forward, middle, or rearward positions by choosing the appropriate column of holes 24 through which bolts 30 are inserted. Horizontal back support members 26 and 28 are depicted in the rearward position in FIG. 1. Additionally by choosing appropriate lengths of braces 58 and 62 and back support members 26 and 28, vending machines of different widths may be accomodated.

Indicated by reference characters 32, 34, 36 and 38 are top left side, bottom left side, top right side, and bottom right side support members, respectively. Top and bottom left side support members 32 and 34 are welded to vertical back support member 10 at the intersections indicated by reference characters 40 and 42, respectively. Similarly, top and bottom left support members 36 and 38 are welded to right horizontal back support member 12 at intersections 44 and 46. The side support members are formed from 1"×2" rectangular steel tubing or bars.

Left and right front vertical support members 48 and 50 formed from 1"×2" steel tubing are welded at their bottom ends to bottom side support members 34 and 38, and at their top ends to top side support members 32 and 36, respectively. Front support members 48 and 50 are parallel to back support members 10 and 12 and perpendicular to side support members 32, 34, 36 and 38.

Left and right ground contacting members 52 and 54, which are also formed from 1"×2" rectangular steel tubing, are welded to lower side support members 34 and 38 immediately below front support members 48 and 50, respectively. Ground support members 52 and 54 contact floor 4 to support the front of security system 2.

Vertical support members 10, 12, 48 and 50, back support members 26 and 28, side support members 32, 34, 36 and 38, and ground contacting members 52 and 54 assembled as above-described thus comprise the free-standing metal cage 9.

A cage door generally indicated at 56, comprises a door frame 57 formed by a top brace 58, a side brace 60, and bottom brace 62. Top brace 68 is welded at one end to side brace 60 along intersection 64, while bottom brace 62 and side brace 60 are welded together at intersection 66. The left ends of top and bottom braces 58 and 62 are rotatably attached to top left side brace 32 and bottom left side brace 34 by hinges 68 and 70, respectively. With the frame of door 56 constructed as above-described, top door braces 58 and bottom door brace 62 are parallel to each other and generally parallel to back support members 26 and 28. Side brace 60 is parallel to horizontal support members 10, 12, 48, and 50.

Hinges 68 and 70 are heavy-duty metal hinges designed to: (a) support the weight of the frame of door 56; and (b) prevent unauthorized removal of door 56 from the free-standing metal cage.

Figure 2:
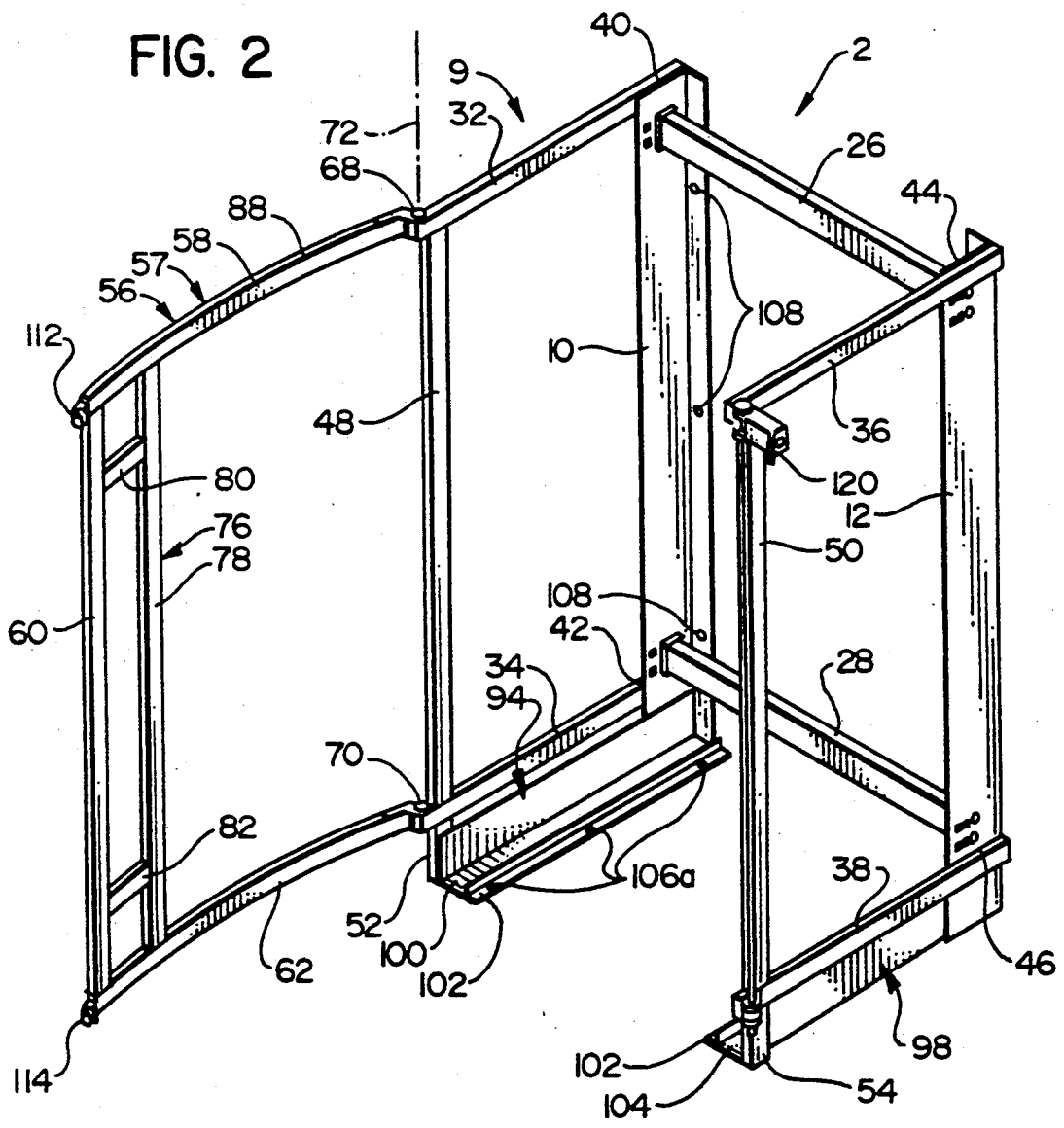
FIG. 2 is a perspective view of the security system of a first embodiment in which the door is depicted in an open position.

The frame 57 of door 56 rotates about hinge axis 72 between a closed position, as shown in FIG. 1, and an open position as shown in FIG. 2. Vending machine 8 may easily be serviced with door 56 in the open position.

In the preferred embodiments, top and bottom door braces 58 and 62 are curved slightly toward the front of security system 2. Top and bottom door braces 58 and 62 thus generally conform to the convex front surface of vending machine 8. This convex front surface is indicated by dotted line 74. Taller machines extend past top side support members 32 and 36 and top door brace 58, or shown in FIG. 1. Therefore, various heights of vending machines may be accommodated within security system 2.

A seam protection structure, which is generally indicated by reference character 76, is mounted within the frame 57 of door 56. More particularly, in the first embodiment of the present invention seam protection structure 76 includes a metal vertical bar 78 and metal horizontal bars 80 and 82. Bar 78 is welded to door braces 58 and 62 at intersection 84 and 86, respectively. Bar 80 is welded at intersection 88 to vertical bar 78 and at intersection 90 to side brace 60. Similarly, bar 82 is welded to vertical bar 78 and side brace 60 at seams 92 and 94. Bars 78, 80, and 82 may be solid bars or hollow tubing. The placement and dimensions of bars 78, 80, and 82 of the preferred embodiment will be discussed below in further detail with reference to FIGS. 3, 4, 9, and 10.

Left and right floor mounting members 96 and 98 are welded to the bottom of security system 2. Floor mounting members 96 and 98 are formed of angled steel having an L-shaped cross section. Left floor mounting member 96 is welded to the bottom of vertical support member 10 and to floor contact member 52 such that an elongate portion 100 thereof abuts floor 4.

A guide rail 102 is arranged on top of the elongate portion 100. The guide rail 102 upwardly extends from the top surface of elongate portion 100 to provide a surface for guiding feet 103 (FIG. 11) of vending machine 8 onto elongate portion 100.

Figure 11:
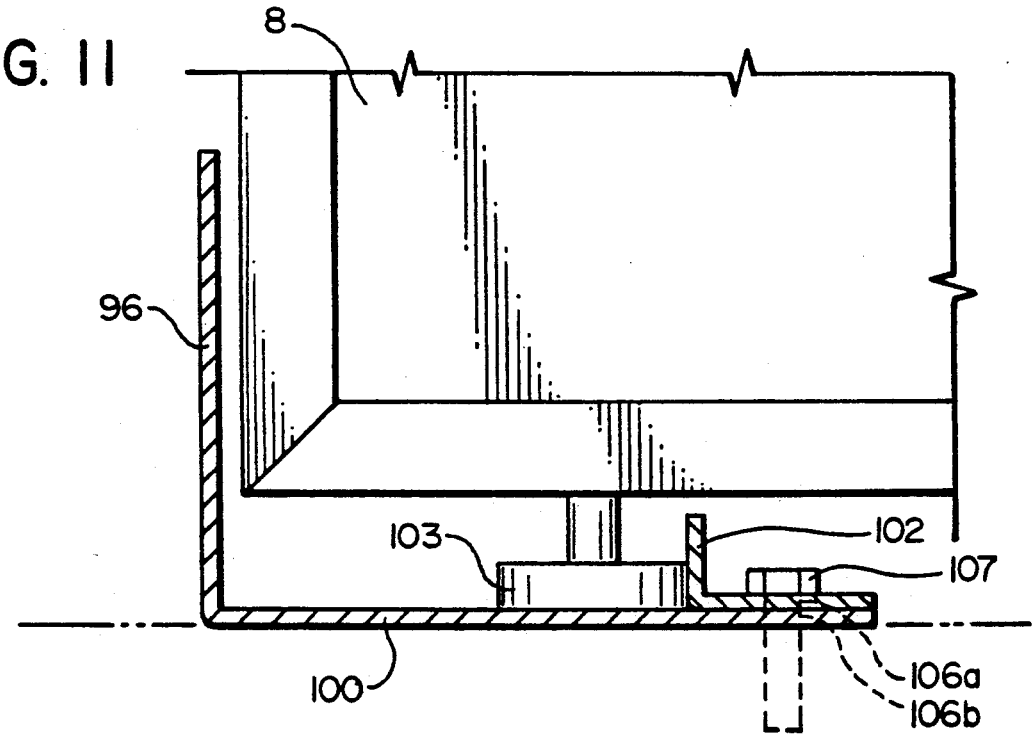
FIG. 11 is an enlarged side view of a guide rail of the present invention.

Holes 106*a* (FIG. 2) and 106*b* (FIG. 11) are spaced at intervals along the lengths of guide rail 102 and elongate portion 100, respectively. These holes are aligned such that belts 107 protrude therethrough into floor 4 (FIG. 11).

Floor support member 98 is similarly connected to vertical support member 12 and floor contacting member 54 such that an elongate portion 104 thereof also abuts floor 4. A second guide rail (not shown) is arranged on top of the elongate portion 104. Holes (not shown) similar to holes 106*a* and 106*b* are formed along the lengths of the second guide rail and elongate portion 104. Bolts (not shown) are inserted through the holes in the second guide rail and the elongate portion 104 and into the floor.

The holes formed in the elongate portions of floor mounting members 96 and 98 allow the security system 2 to be secured by bolts 107 to floor 4. Additionally, the guide rails guide the vending machine feet onto elongate portions 100 and 104 to facilitate the placing of the vending machine 8 into the cage 9 of the security system 2. With vending machine 8 so placed within cage 9, the vending machine covers the bolts inserted through the holes in floor mounting members 96 and 98. The substantial weight and bulk of the vending machine prevents the unauthorized removal of these bolts.

In similar fashion, holes 108 (FIG. 2) are formed in short portion 18 of vertical support member 10. Security system 2 may be bolted to wall 6 by bolts 108*a* through holes 108 and similar holes (not shown) formed in short portion 20 of vertical support member 12. With security system 2 bolted to floor 4 and/or wall 6, the vending machine 8 may not easily be tipped over. Vending machine 8 also covers the bolts attaching cage 9 onto wall 6 to prevent the unauthorized removal thereof.

Indicated generally by reference character 110 is a locking system for locking door 56 into the closed position depicted in FIG. 1. Locking system 110 includes: (a) claw-shaped securing members 112 and 114 welded onto the ends of top and bottom door braces 58 and 62, respectively; (b) lock rod 116 attached to side support members 36 and 38 such that it can axially rotate about the axis indicated by arrow 118; and (c) a lever 120 employed to rotate rod 116 about axis 118. FIG. 1 depicts locking system 110 with lever 120 rotated into a secured and locked position, while in FIG. 2 locking system 110 is depicted with lever 120 rotated 90° into an unsecured and unlocked position. Locking system 110 will be discussed below in further detail with reference to FIGS. 5–8.

Figure 3:
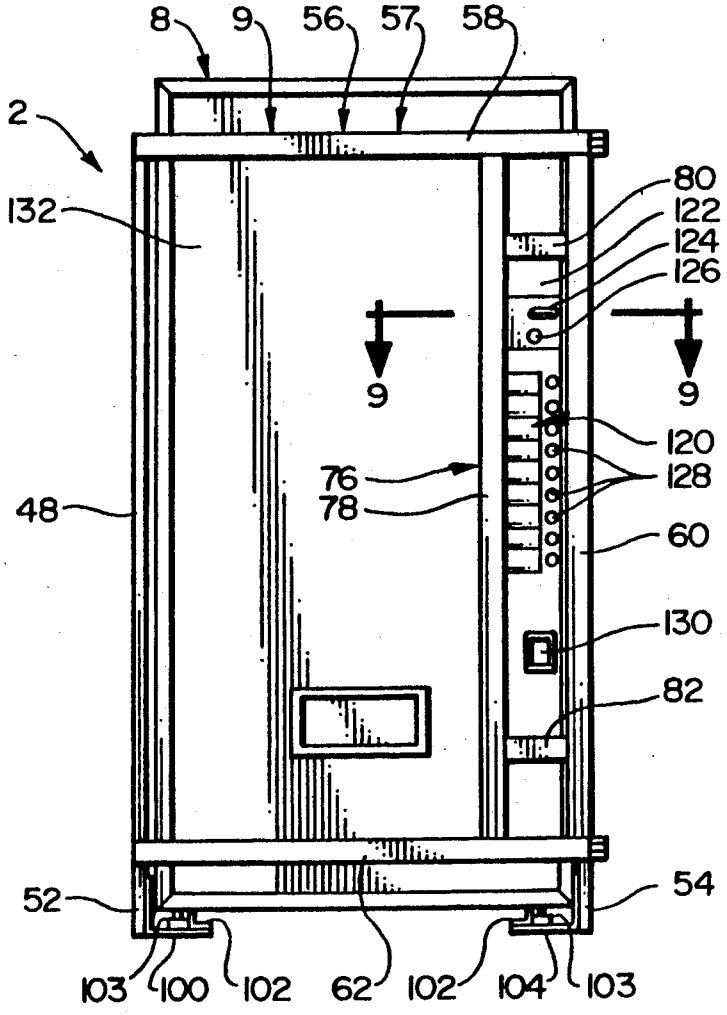
FIG. 3 is a front view of the first embodiment of a security system embodying the principles of the present invention.

FIG. 3 depicts the security system 2 of the first embodiment being employed to protect vending machine 8. Vending machine 8 includes a selection panel 120. Selection panel 120 comprises a front surface 122 having a coin slot 124, a coin return button 126, selection button 128, and a change dispensing orifice 130. Seams between a main front panel 132 of vending machine 8 and front surface 122 of selection panel 120 are hidden by seam protection bars 78, 80 and 82. The seam protection bars are wide enough, close enough to the front panel, and sturdy enough to prevent persons from obtaining unauthorized access to the interior of vending machine 8 by inserting a screwdriver, crowbar, or similar tool into the exposed seams.

Figure 9:
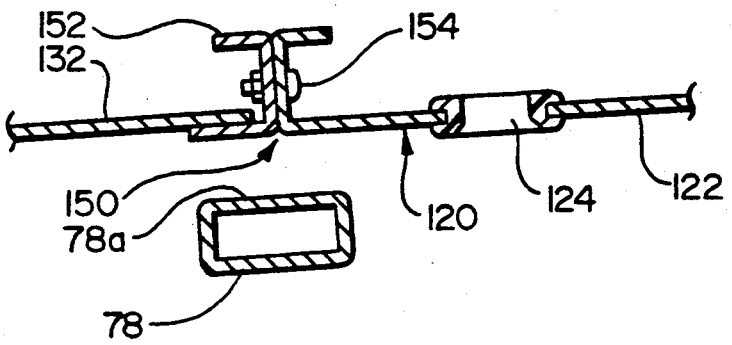
FIG. 9 is a top, cut-away view of a seam and seam protection bar taken along arrows 9 in FIG. 3.1.

In the preferred embodiments, the seam protection bars are formed from hollow, extruded 1"×2" rectangular steel bars (FIG. 9). When door 56 is closed, a two inch wide surface of these bars is situated approximately 1 to 2 inches from and along the length of the seams on the front surface of the vending machine. Further, the seam protection bars should be secured within frame 57 such that they are substantially symmetrical in width about the seam to be protected when door 56 is closed.

Further seams are formed by a front door and the top, bottom, and side of the vending machine 8. Seams between the front of vending machine 8 and the left and right sides of vending machine 8 are generally indicated by reference characters 134 and 136 in FIG. 1. Seams along lines 134 and 136 are substantially protected by vertical side support members 48 and 50, respectively. Vertical support members 48 and 50, are from 1" to 2" away from seams 134 and 136, respectively.

Figure 4:
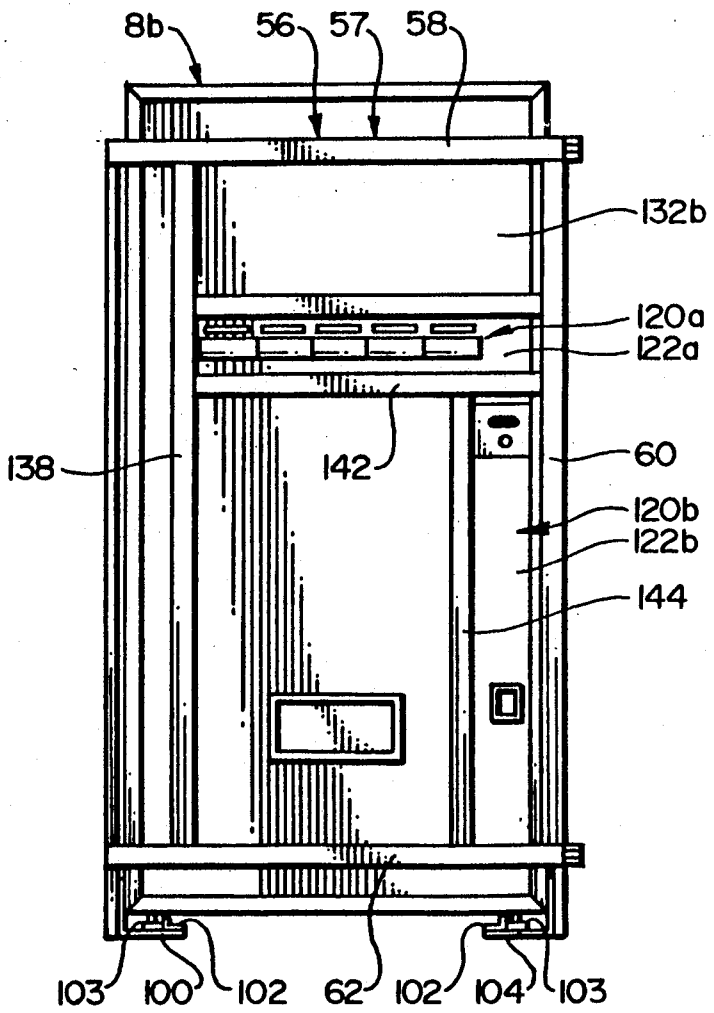
FIG. 4 is a front view of a second embodiment of the present invention.

FIG. 4 depicts a second embodiment of the present invention in which the invention is adapted to protect a vending machine 8*b* having a different selection panel. In the discussion of FIG. 4, components of the second embodiment that are the same as the components in the first embodiment are given the same reference characters, with a letter suffix distinguishing those of the second embodiment.

On the front surface 132*b* of vending machine 8*b*, a product selection panel 120*a* horizontally extends across the front surface 132*b*. A money handling panel 120*b* extends from the product selection panel 120*a* along one side of the main front panel 132*b* to the bottom thereof. Seams are thus formed at the juncture of product selection panel 120*a* and money handling panel 120*b* in a generally L-shaped configuration.

To protect these seams, a vertical seam protection bar 138 is welded at its upper end to door brace 58 and at its lower end to door brace 62. Horizontal seam protection bars 140 and 142 are welded in parallel between vertical seam section bar 138 and door brace 60. In this embodiment, an additional vertical seam protection bar 144 is welded at its upper end to seam protection bar 142 and at its lower end to door brace 62.

The seam protection bars of door 56 thus formed protect the generally L-shaped configuration of seams between product selection panel 120*a* and front panel 132 and between money handling panel 120*b* and front panel 132.

Figure 10:
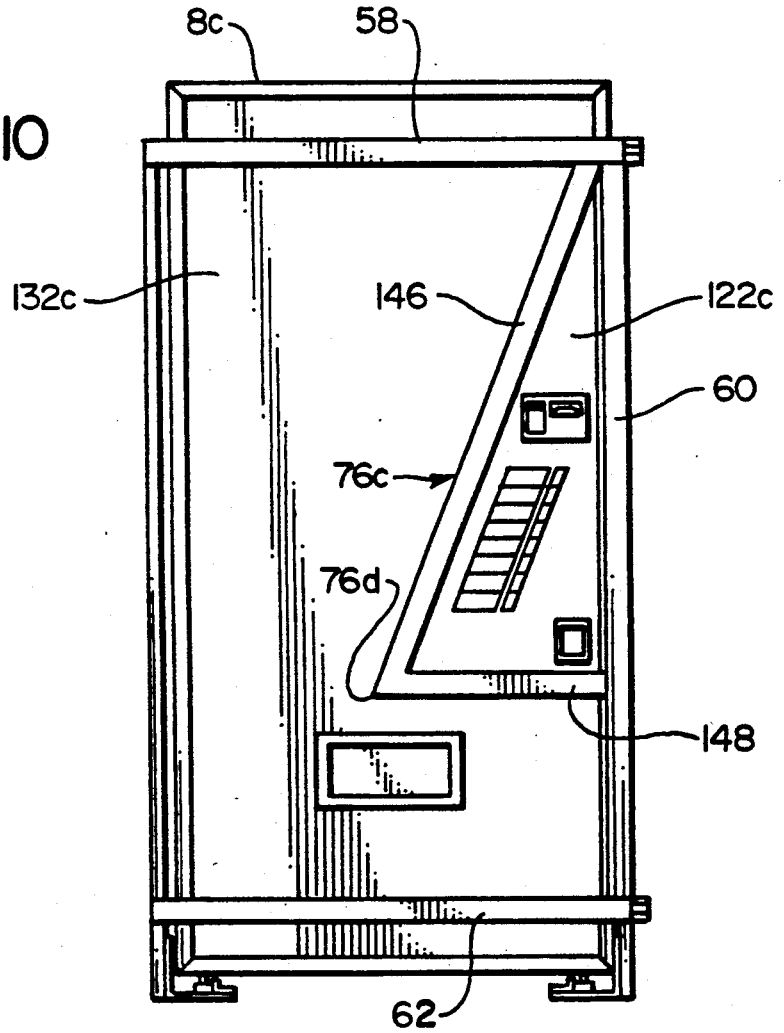
FIG. 10 is a front view of a third embodiment of the present invention.

FIG. 10 depicts a third embodiment of the present invention showing seam protection structure 76 adapted to cover the slanted and horizontal seams between main front panel 132*c* and selection panel 120*c* of vending machine 8*c*. Structure 76*c* comprises a slanted bar 146 and a horizontal bar 148 joined to top door brace 58 and side door brace 60, respectively. Bars 146 and 148 are also joined together at intersection 76*d*.

It should be clear that with appropriate placing of the seam protection bars of the seam protection structure, the seams formed by any configuration of front panels on vending machines may be suitably protected.

More specifically, a seam 150 is depicted in FIG. 9. This seam 150 is formed at the junction of a structural member 152 and selection panel 120. Structural member 152 is a piece of angle iron that is designed to join with panel 120. Structural member 152 and selection panel 120 are joined by a nut and bolt combination 154. Along the length and width of the seam protection bar 78 is a face 78*a*, which is presented towards seam 150. The face 78 is two inches wide and is situated approximately one to two inches from seam 140 when door 56 is closed.

So situated, the seam protection bar 78 prevents damage by vandalism to structural member 152 or selection panel 120, which are difficult and expensive to replace. Further, if a crow bar or similar instrument were to obtain a fulcrum on structural member 152, sufficient leverage may be generated to pry open selection panel 120. Seam protection bar 78 denies this fulcrum to a thief or vandal. On the other hand, while main front panel 132 is exposed and may be damaged, it is easily and cheaply replaced.

As is apparent from FIGS. 3, 4, and 10, selection and extraction of products sold through vending machines 8, 8*b*, and 8*c* is unhindered. Further, advertising displayed on the front surfaces 132 and 142 of the vending machines is easily visible through the seam protection structure. The security system 2 may be finished in colors matching that of the vending machine to present a more pleasing appearance.

Locking system 110 will now be discussed with reference to FIGS. 5–8.

Figure 5:
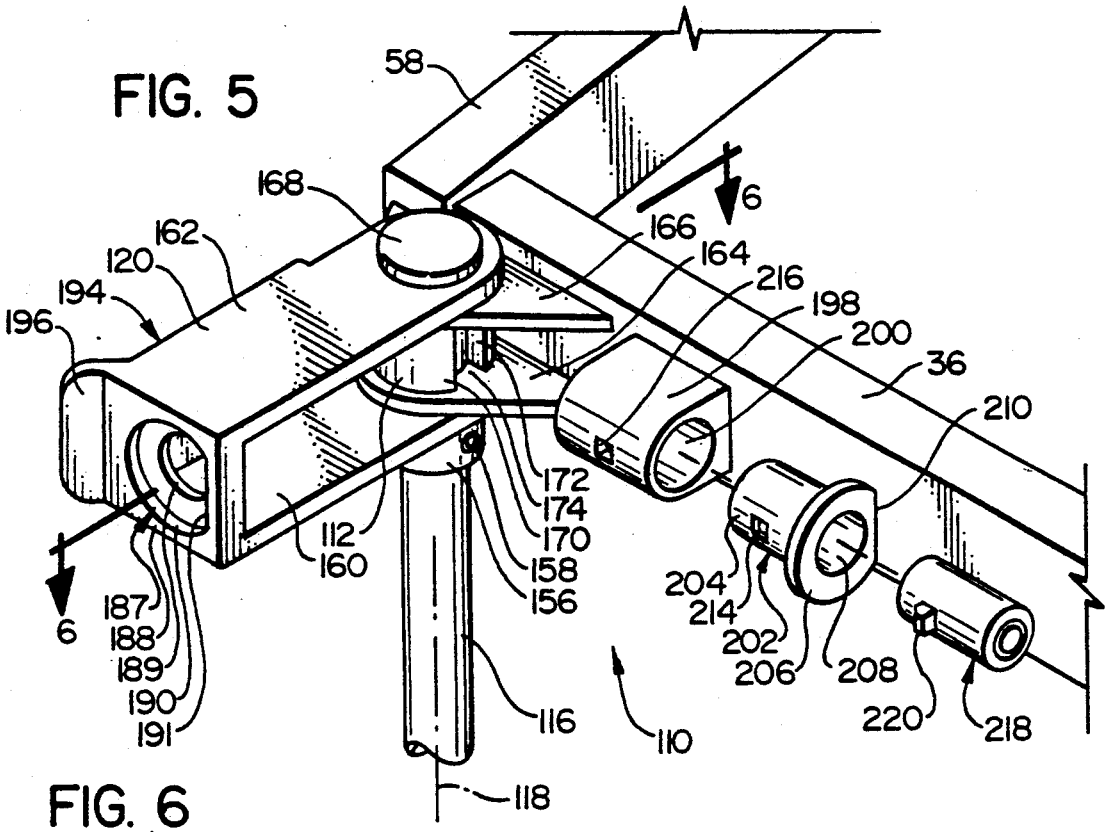
FIG. 5 is a perspective, exploded view of a top portion of the securing mechanism of the present invention in an unsecured and unlocked state.
Figure 7:
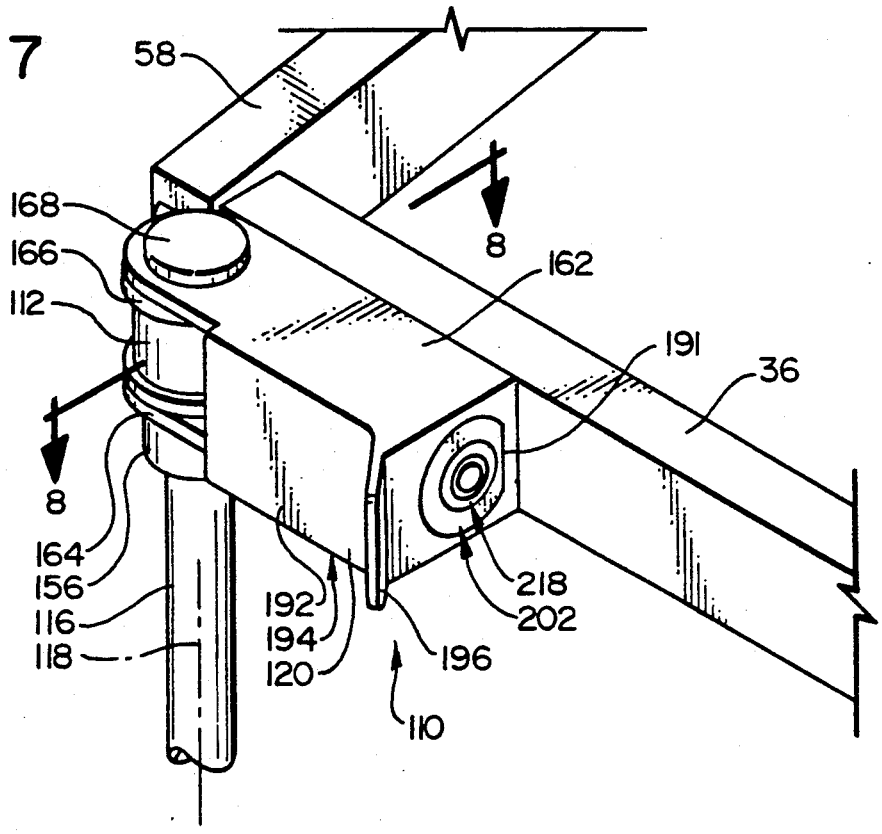
FIG. 7 is a perspective view of the securing mechanism of the present invention in a secured, and locked state.
Figure 8:
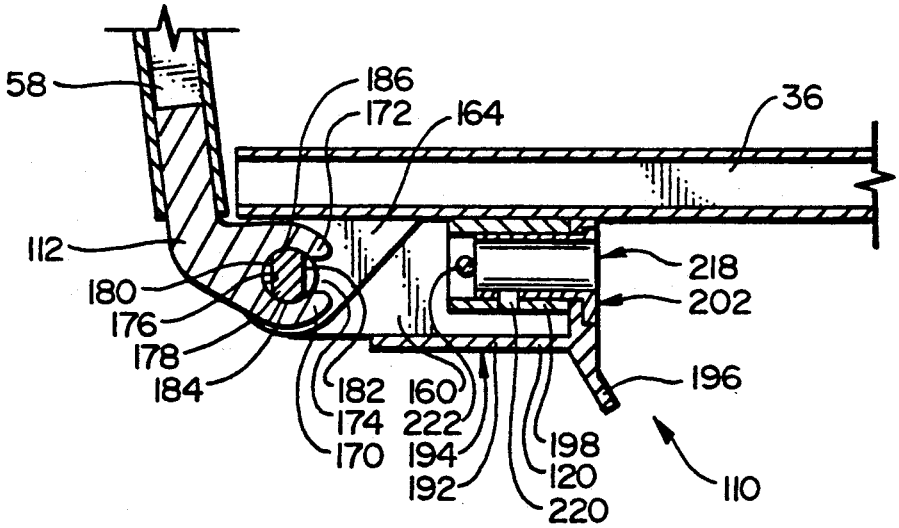
FIG. 8 is a top, cut-away view of the securing mechanism of the present invention taken along arrows 8 in FIG. 7.

Lock rod 116 of locking system 110 is attached to cylindrical portion 156 of lever 120 by set screw 158. Manual rotation of lever 120 about axis 118 causes axial rotation of lock rod 116 between secured and unsecured positions. The secured position is shown in FIGS. 1, 7, and 8, while the unsecured position is shown in FIGS. 2, 5, and 6.

Lock rod 116 extends through cylindrical portion 156 and bottom and top walls 160 and 162 of lever 120. Further, brackets 164 and 166 outwardly extend in parallel from support member 36. Lock rod 116 further extends through holes in brackets 164 and 166. When assembled, brackets 164 and 166 are between walls 160 and 162, and securing member 112, which is attached to door bracket 58, is inserted between brackets 164 and 166 as door 56 is closed. A stop disk 168 welded on to the top of lock rod 116 secures lock rod 116 in place.

Figure 6:
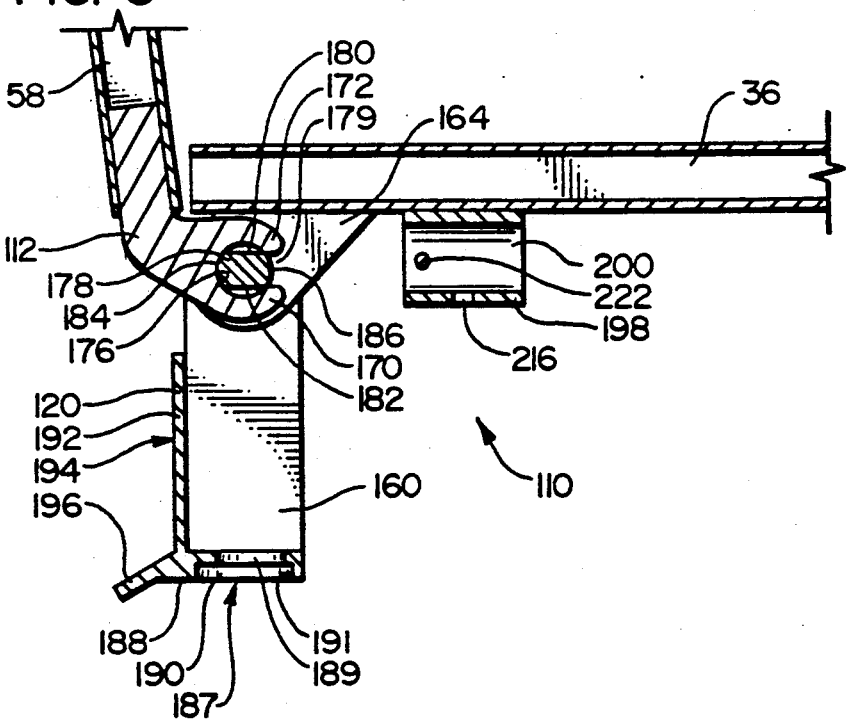
FIG. 6 is a top, cut-away view of the securing mechanism of the present invention taken along arrows 6 in FIG. 5.

Referring now to FIG. 6, it can be seen that fingers 170 and 172 are integrally formed on securing member 112. A gap 174 is formed between the tips of fingers 170 and 172. A generally cylindrical void 176 is defined by the connected inner surfaces of fingers 170 and 172.

Indicated by reference character 178 is a locking portion of lock rod 116. Two flattened sides 180 and 182 are formed on lock rod 116 at locking portion 178 by grooves cut transverse to the axis of lock rod 116. Indicated by reference characters 184 and 186 are curved surfaces between flattened surfaces 180 and 182. The thickness of lock bar 116 between flattened portions 180 and 182 is slightly smaller than gap 174 between fingers 170 and 172.

When door 56 is rotated into the closed position, curved surface 184 enters void 176 through gap 174. Once door 56 is completely closed, curved surface 184 contacts the inner surface of claw-shaped member 112 surrounding void 176. With locking portion 178 oriented such that flat surfaces 180 and 182 are parallel to support member 36, as shown in FIG. 6, lock bar 116 is in the unsecured position and door 56 may be easily moved between the open and closed position.

Referring back to FIG. 5, lock hole 187 is formed in an end piece 188 of lever 120. The lock hole 187 comprises a narrow cylindrical portion 189 and a wider portion 190. A projection 191 projects into wider portion 190. End piece 188, top plate 162, bottom plate 160, and a cover 192 are welded together to form a lock cover 194. Handle 196 protrudes from lock cover 194 to facilitate manual rotation of lever 120.

A lock barrel 198 is welded onto support member 36 adjacent to brackets 164 and 166. A barrel hole 200 is bored through lock barrel 198 parallel to support member 36. The diameter of barrel hole 200 is approximately the same as diameter of narrow portion 189 of hole 187 in end piece 187.

A lock sleeve is indicated by reference character 202. Lock sleeve 202 comprises a cylindrical portion 204 and a disk-shaped washer portion 206. Cylindrical portion 204 and washer portion 206 are aligned along a common axis.

The outer diameter of cylindrical portion 204 is slightly smaller than the diameter of narrow portion 189 of lock hole 187 and hole 200.

A sleeve hole 208 is formed in lock sleeve 202 along the common axis of cylindrical portion 204 and washer portion 206. A notch 210 is formed on the edge of washer portion 206 to allow lock sleeve 202 to be inserted past projection 19 and into holes 187 and 200. When the lock sleeve 202 is so inserted, the outer face of washer portion 206 is flush with the surface of end piece 188. Notch 210 and projection 191 ensures that a dog hole 214 in lock sleeve 202 is aligned with a dog hole 216 in lock barrel 198.

A cylindrical lock is indicated by reference character 218. Lock 218 is well known and may be supplied and replaced by the owner of the vending machines to be protected. The outer diameter of lock 218 is slightly smaller than that of sleeve hole 208 to allow lock 218 to be inserted therein. A stop bar 222, which is mounted within and transverse to hole 200, stops sleeve 202 and lock 218 when dog holes 214 and 216 are aligned and prevents lock 218 from being forced through hole 200.

A lock dog 220 radially extends from lock 218. By turning a key in lock 218, lock dog 220 moves between fully and partially extended positions. When lock 218 is inserted into sleeve 202, lock dog 220 extends into hole 214 when lock dog 220 is partially extended. When lock dog is fully extended, lock dog 220 passes through hole 214 and projects radially from the outside of cylindrical portion 204.

When lever 120 is rotated about axis 118 until lock protection box 194 is in the secured position shown in FIG. 7, lock cover 194 completely covers lock barrel 198. Additionally, as shown in FIG. 8, flat surfaces 180 and 182 are rotated by 90° and are thus perpendicular to support member 36. Curved surfaces 184 and 186 and flat surface 182 thus act on the inner surfaces of fingers 170 and 172 to prevent securing member 112 from being withdrawn from the locked position. Accordingly, as long as lever 120 is held in the secured position, door 56 cannot be opened.

To lock door 56, therefore, an operator: (a) rotates door 56 into the closed position after making sure that lever 120 is in the unsecured position; (b) rotates lever 120 into the secured position; (c) inserts lock 218 and lock sleeve 202 into holes 187 and 200; and (d) turns the key for lock 218 to fully extend lock dog 220 through dog holes 214 and 216. Door 56 is unlocked by reversing the process just described.

With sleeve 202 so inserted and lock dog 220 fully extended, sleeve 202 cannot be removed from holes 188 and 198, and sleeve 202 prevents lever 120 from being rotated out of the secured position. Door 56 is thus securely locked in its closed position. Further, because washer portion 206 is flush with the surface of end piece 188, leverage cannot be applied to remove lock sleeve 202 from holes 187 and 220 when lock dog 220 is fully extended.

If force is applied to lever 120 in an attempt to gain unauthorized entry into the protected vending machine, end piece 190 contacts sleeve 202 rather than lock 218. Damage to lock 218 is thus prevented.

While not explicitly shown, a locking portion similar to locking portion 178 is formed on the bottom of lock bar 116. Securing member 114 and its corresponding locking portion thus prevent the bottom of door 56 from being opened in the same manner as securing member 112 and locking portion 178. With this arrangement, only one lever 120 and lock 218 need be used to lock both the top and bottom corners of door 56.

It should be noted that all components of security system 2 are constructed from suitably rugged steel. Hollow tubes, solid steel bars, or flat iron may be used for any of the support members or seam protection bars. Joints are formed by welding or similar process, if possible. When components need to be adjustable, roundhead bolts with hidden nuts are employed to minimize the possibility of unauthorized disassembly. Door 56 is attached with heavy duty metal hinges with tamperproof pins. Additionally, security system 2 would normally be attached to floor 4 and/or wall 6 by bolts through holes such as holes 106*a*, 106*b*, and 108. When vending machine 8 is within security system 2, nuts and bolts used to attach the cage to floor 4 and wall 6 are hidden by the bottom and back of vending machine 8. Similarly, lock cover 194 covers and protects most of the locking mechanism and set screw 158 when door 56 is in the secured position.

Accordingly, security system 2 constructed as described above: (a) is securely mounted to floor 4 and/or wall 6 to prevent security system 2, and thus vending machine 8, from being tipped over; (b) protects all vulnerable seams of vending machine 8; and (c) is ruggedly and inexpensively constructed.

In the preferred embodiments, one lever and lock were used to secure and lock both the top and bottom corners of door 56. Optionally, lock rod 116 running the length of front support member 50 may be omitted in favor of two short lock rods, in which case a lever and lock combination must be provided at both the top and bottom corners of door 56.

It should also be understood that the location and dimensions of the seam protection bars described herein are for three specific vending machines and may be changed as appropriate to protect the seams of vending machines having different front panel arrangements. Further, the dimensions, placement, and proximity to the seams to be protected of vertical support members 48 and 50 and the bars of seam protection structure 76 may be varied while still obtaining the result of protecting vulnerable seams.

For example, with the above-described seam protection bars having a 1"×2" cross-section, the bars should be placed not more than 3" from the seam to be protected to prevent tools from being inserted therebetween. If the cross-section of such bars is reduced to 1"×1" or they are not symmetrically arranged astride the seam, the bars should be placed closer to the seam to be protected than three inches. On the other hand, if the seam protection bar is formed from a five inch wide piece of flat steel, the bar may be placed more than three inches from the seam to be protected.

Accordingly, the present invention may be embodied in forms other than those disclosed above without departing from the spirit or essential characteristics of the present invention. The present embodiments are therefore to be considered in all respects as illustrative and not restrictive, the scope of the invention being indicated by the appended claims rather than by the foregoing description. All changes that come within the meaning and range of equivalency of the claims are therefore intended to be embraced therein.

What is claimed is:

1. A security system for protecting free-standing vending machines, comprising:

a. metal cage adapted to surround a substantial portion of the vending machine, the cage having vertical support members at the corners thereof which substantially cover seams at or near the corners of the vending machine;

b. a metal door rotatably attached at two points to the cage by metal hinges, a frame of the door including top, bottom, and side braces constructed to conform to a front surface of the vending machine;

c. securing means mounted on the cage and door for selectively securing the door to the cage in a closed position; and d. mounting means for securely attaching the cage to a floor on and/or wall against which the cage and vending machine are placed.

2. The security system of claim 1, further comprising: a seam protection structure formed within the door frame braces and adapted to cover vulnerable seams existent on the front surface of the vending machines.

3. The security system of claim 2, in which the seam protection structure comprises a vertical bar between the top and bottom braces and one or more horizontal bars between the vertical bar and the side brace.

4. The security system of claim 1, in which the securing means comprises:

a. a lock bar rotatably mounted on one of the vertical support members, the lock bar having a locking portion or portions at which flattened surfaces are formed on opposite sides of the lock bar and non-flattened surfaces are formed on opposite sides of the lock bar between the flattened surfaces;

b. a securing member or members attached to the door frame having fingers that surround a substantial portion of the lock bar when the door is in the closed position, where i. the width of the lock bar between the flattened surfaces is narrower than a gap formed between the ends of the fingers, and ii. the width of the lock bar between the non-flattened surfaces is greater than the gap formed between the ends of the fingers; and c. a lever for rotating the lock bar about its axis between secured and unsecured positions; whereby d. the flattened surfaces are oriented with respect to the finger to allow retraction of the locking portion from the securing member through the gap when the lock bar is in the unsecured position; and e. the non-flattened surfaces are oriented with respect to the fingers to contact these fingers and prevent retraction of the locking portion through the gap when the lock bar is in the secured position.

5. The security system of claim 4, in which the securing means further comprises locking means for locking the lever to prevent the lock bar from being rotated out of the secured position.

6. The security system of claim 5, in which:

a. the lever has a hole formed therein; and b. the locking means comprises:

i. a barrel attached to the cage such that a barrel hole formed therein is aligned with the lever hole when the lock bar is in the secured position;

ii. a lock unit inserted into the aligned lock and barrel holes; and iii. a lock dog, extending from the lock unit, which is selectively inserted into or removed from a first dog hole formed in the lock barrel to prevent unauthorized removal of the lock unit from the lock and barrel holes.

7. The security system of claim 6, in which the lock unit comprises:

a. a lock sleeve having a second dog hole formed therein; and b. a key-operated lock inserted through the lock sleeve, whereby the lock moves the lock dog in response to turns of the key between i. a fully extended position in which the lock dog extends through the first and into the second dog holes, and ii. a partially extended position in which the lock dog extends only into the second lock dog.

8. The security system of claim 2, in which the seam protection structure comprises vertical and horizontal bars connected between the top, bottom, and side braces, the vertical and horizontal bars being dimensioned and arranged corresponding to the seams on the front surface of the vending machine.

9. The security system of claim 1, in which the metal cage is free-standing and further comprises back horizontal support members secured between back vertical support members by adjustable attaching means, where:

a. the length of the back support members is slightly greater than the width of the vending machine to be protected; and b. the place at which the horizontal back support members are attached by the adjustable attaching means to the vertical support members is variable according to a depth of the vending machine to be protected.

10. The security system of claim 9, in which:

a. the vertical back support members are formed from angled steel, with opposing surfaces on each vertical back support member substantially parallel to each other; and b. holes are formed in the parallel surfaces through which bolts are inserted to attach the horizontal back support members to the vertical back support members, the holes being situated to allow frontward and backward adjustment of the horizontal back support members.

11. The security system of claim 1, in which the top and bottom braces of the door frame are outwardly curved to conform to a convex front surface of the vending machine.

12. The security system of claim 1, in which the attaching means comprises floor mounting members formed of angled steel, the floor mounting members having a floor contacting portion and a support member contacting portion; whereby the floor contacting portions have holes formed therein to allow the floor mounting members to be secured to a floor on which the vending machine is placed; and the support member contacting portions of each floor mounting member are securely fastened to two vertical support members.

13. The security system of claim 12, in which the attaching means further comprises holes formed in a wall contacting portion of two adjacent vertical support members, where the holes allow bolts to be inserted therethrough for securing the security system to the wall against which the vending machine is to be mounted.

14. The security system of claim 2, in which the seam protection structure comprises 1"×2" rectangular hollow bars located no more than 3", preferably from 1" to 2", from the front surface of the vending machine when the door is in the closed position.

15. A security system for protecting free-standing vending machines, comprising:

a. a free-standing metal cage adapted to surround a substantial portion of the vending machine, the cage having i. front and back vertical support members;

ii. top and bottom horizontal side support members welded at each end to vertical support members; and iii. top and bottom horizontal back support members attached at each end to opposing back vertical support members;

b. a metal door rotatably attached at two points to the cage by metal hinges, a frame of the door including top and horizontal braces and a side vertical brace, where the top and bottom vertical braces are constructed to conform to a front surface of the vending machine;

c. securing members welded onto the door frame opposite the hinges;

d. a lock bar having securing means formed thereon for selectively engaging the securing members to secure the door in a closed position, the lock bar being axially rotatable between i. a secured position in which the securing means engage the securing members to prevent the door from being rotated out of a closed position, and ii. an unsecured position in which the locking portions do not engage the securing members;

e. a lockable lever for rotating the lock bar between the secured and unsecured positions; and f. a seam protection structure formed within the door frame braces and adapted to cover the vulnerable seams on the front surface of the vending machine to be protected.

16. The security system of claim 15, further comprising floor mounting members attached to the cage with holes formed therein through which bolts are inserted to securely attach the cage to the floor on which the cage and the vending machine are placed.

17. The security system of claim 15, in which the seam protection structure comprises vertical and horizontal metal bars welded to the door frame and/or each other to cover vulnerable seams on the front surface of the vending machine.

18. The security system of claim 17, in which the lockable lever has a hole formed, therein, wherein the axis of the hole radially extends from the lock bar axis and the lever is locked into the secured position by a locking means.

19. The security system of claim 18, in which the locking means comprises:

a. a lock barrel welded onto a top side support member adjacent to the lever, the lock barrel having a hole formed therein that aligns with the hole in the lever when the lever is in its secured position;

b. a lock sleeve adapted to be inserted into the hole in the lever and the barrel hole when the lever is in the secured position; and c. a lock that is inserted into the lock sleeve and which extends a lock dog through holes in the lock sleeve and the lock barrel to prevent the lock and sleeve from being retracted from the hole in the lever and the barrel lever.

20. The security system of claim 15, in which the seam protection structure comprises 1"×2" rectangular hollow bars located no more than three inches, preferably from 1 to 2 inches, from the front surface of the vending machine when the door is in the closed position.

21. A securing mechanism for securing a door frame to a metal cage of a vending machine security system, comprising:

a. a lock bar rotatably mounted at tow points on the cage, the lock bar having a locking portion or portions at which flattened surfaces are formed on opposite sides of the lock bar and non-flattened surfaces are formed on opposite sides of the lock bar between the flattened surfaces;

b. securing members attached to the door frame having fingers that surround a substantial portion of the lock bar when the door is in the closed position, where i. the width of the lock bar between the flattened surfaces is narrower than a gap formed between the ends of the fingers, and ii. the width of the lock bar between the non-flattened surfaces is greater than the gap formed between the ends of the fingers; and c. a lever for rotating the lock bar about its axis between secured and unsecured positions; whereby d. the flattened surfaces are oriented with respect to the finger to allow retraction of the locking portion from the securing member through the gap when the lock bar is in the unsecured position; and e. the non-flattened surfaces are oriented with respect to the fingers to contact these fingers and prevent retraction of the locking portion through the gap when the lock bar is in the secured position.

22. The securing mechanism of claim 21, further comprising locking means for locking the lever to prevent the lock bar from being rotated out of the secured position.

23. The security system of claim 22, in which:

a. the lever has a hole formed therein; and b. the locking means comprises:

i. a barrel attached to the cage such that a barrel hole formed therein is aligned with the lever hole when the lock bar is in the secured position;

ii. a lock unit inserted into the aligned lock and barrel holes; and iii. a lock dog, extending from the lock unit, which is selectively inserted into or removed from a first dog hole formed in the lock barrel to prevent unauthorized removal of the lock unit from the lock and barrel holes.

24. The securing mechanism of claim 23, in which the lock unit comprises:

a. a lock sleeve having a second dog hole formed therein; and b. a key-operated lock inserted through the lock sleeve, whereby the lock moves the lock dog in response to turns of the key between i. a fully extended position in which the lock dog extends through the first and into the second dog holes, and ii. a partially extend position in which the lock dog extends only into the second lock dog hole.

25. A combination of:

a. a vending machine having seams formed by abutting edges of:

i. a structural member on which a front panel of the vending machine is mounted; and ii. a selection panel on which product selection buttons, a coin or bill slot, a change orifice, or the like are mounted; and b. a cage surrounding the vending machine having a door, with seam protection bars formed within a frame of the door;

whereby the seam protection bars extend the length of and are adjacent to the seams on the vending machine.

26. The combination of claim 25, in which the seam protection bars have a surface opposing and spaced a fixed distance from the seam.

27. The combination of claim 26, in which the seam protection bars are substantially symmetrically placed about the seams.

28. The combination of claim 27, in which the opposing surface on the seam protection bars extends one inch on either side of the seams and are placed no more than three inches, preferably from one to two inches, from the seam.

29. The security system of claim 2, in which the seam protection structure comprises a slanted bar and a horizontal bar, where the slanted and horizontal bars are attached at one end, the slanted bar is attached at to the top brace, and the horizontal bar is attached to the side brace.

30. The security system of claim 15, in which the seam protection structure comprises a slanted bar and a horizontal bar, where the slanted and horizontal bars are attached at one end, the slanted bar is attached at the top brace, and the horizontal bar is attached to the side brace.

31. The security system of claim 12, In which the floor mounting members further comprise a guide rail having a surface for guiding feet of the vending machine onto the floor mounting members.

32. The security system of claim 31, in which the guide rail has holes formed thereon aligned with the holes in the floor contacting portions, where bolts protrude through the aligned holes to attach the cage to the floor.

33. The security system of claim 16, in which the floor mounting members further comprise a guide rail having a surface for guiding feet of the vending machine onto the floor mounting members.

34. The security system of claim 33, in which the guide rail has holes formed thereon aligned with the holes in the floor contacting portions, where bolts protrude through the aligned holes to attach the cage to the floor.

35. The security system of claim 7, in which, when the lock unit is inserted into the lock and barrel holes, the lock sleeve is flush with the surface of the lever.

36. The security system of claim 19, in which when the lock unit is inserted into the lock and barrel holes, the lock sleeve is flush with the surface of the lever.

37. The security system of claim 24, in which when the lock unit is inserted into the lock and barrel holes, the lock sleeve is flush with the surface of the lever.

* * * * *